US005116056A

United States Patent [19]

Schmutte

[11] Patent Number: 5,116,056

[45] Date of Patent: May 26, 1992

[54] INDOOR GOLF PRACTICE APPARATUS

[76] Inventor: Charles T. Schmutte, 4509 Livingston Way, Sacramento, Calif. 95823

[21] Appl. No.: 579,355

[22] Filed: Sep. 7, 1990

[51] Int. Cl.[5] ..... A63B 69/36

[52] U.S. Cl. ..... 273/181 F; 273/176 B; 273/26 A; 160/330

[58] Field of Search ..... 273/181 X, 181 F, 29, 273/26 A, 406, 407, 410, 176 R, 176 B, 181 A, 181 J, 35 R; 160/113, 330, 349.1

[56] References Cited

U.S. PATENT DOCUMENTS

| | | | |
|---|---|---|---|
| 841,611 | 1/1907 | Alsop | 273/410 |
| 1,166,496 | 1/1916 | Torrey | 273/410 |
| 1,206,421 | 11/1916 | Dickey | 160/330 |
| 1,677,442 | 7/1928 | Hall | 273/181 A |
| 1,818,786 | 4/1985 | Bond | 160/346 |
| 2,922,653 | 1/1960 | O'Brien | 273/410 |
| 3,227,449 | 1/1966 | Schwab | 273/181 F |
| 3,392,420 | 7/1968 | Kless | 160/346 X |
| 3,434,524 | 3/1969 | Fein | 160/345 |
| 3,558,140 | 1/1971 | Romeo | 273/181 |
| 3,784,207 | 1/1974 | Gentiluomo | 273/185 R X |
| 3,986,719 | 10/1976 | Lee | 273/181 F |
| 4,153,246 | 5/1979 | Byrne | 160/113 |
| 4,180,352 | 12/1979 | Divers et al. | 160/330 X |
| 4,183,524 | 1/1980 | Kifferstein | 273/181 F |
| 4,511,146 | 1/1985 | Windall | 273/185 R X |
| 4,523,760 | 6/1985 | Bednarczuk | 273/181 F |
| 4,557,311 | 12/1985 | Reining | 160/330 |
| 4,623,013 | 11/1986 | Gross | 160/330 X |
| 4,793,399 | 12/1988 | Pryor | 160/345 |
| 4,796,684 | 1/1989 | Haimovitz | 160/330 |

OTHER PUBLICATIONS

"Masco" Catalog, Manufacturing Specialties Co., Los Angeles, Calif., copyright 1961.

*Primary Examiner*—Edward M. Coven
*Assistant Examiner*—Marti S. Graham
*Attorney, Agent, or Firm*—John P. O'Banion

[57] ABSTRACT

An apparatus for practicing golf swings indoors having a net assembly suspended from a support rail attached to an overhead structure such as the rafters in a garage. The net assembly is attached to a plurality of hangers which are slidably attached to the support rail so the net assembly can be pulled to one side when not in use. The net assembly is scrolled at the bottom to form a trough which catches balls directed toward the net and to create a seal with the playing surface and to form. Golf balls directed toward the net assembly from a playing mat having a tee are restrained and caught by the net assembly.

3 Claims, 3 Drawing Sheets

FIG.-2
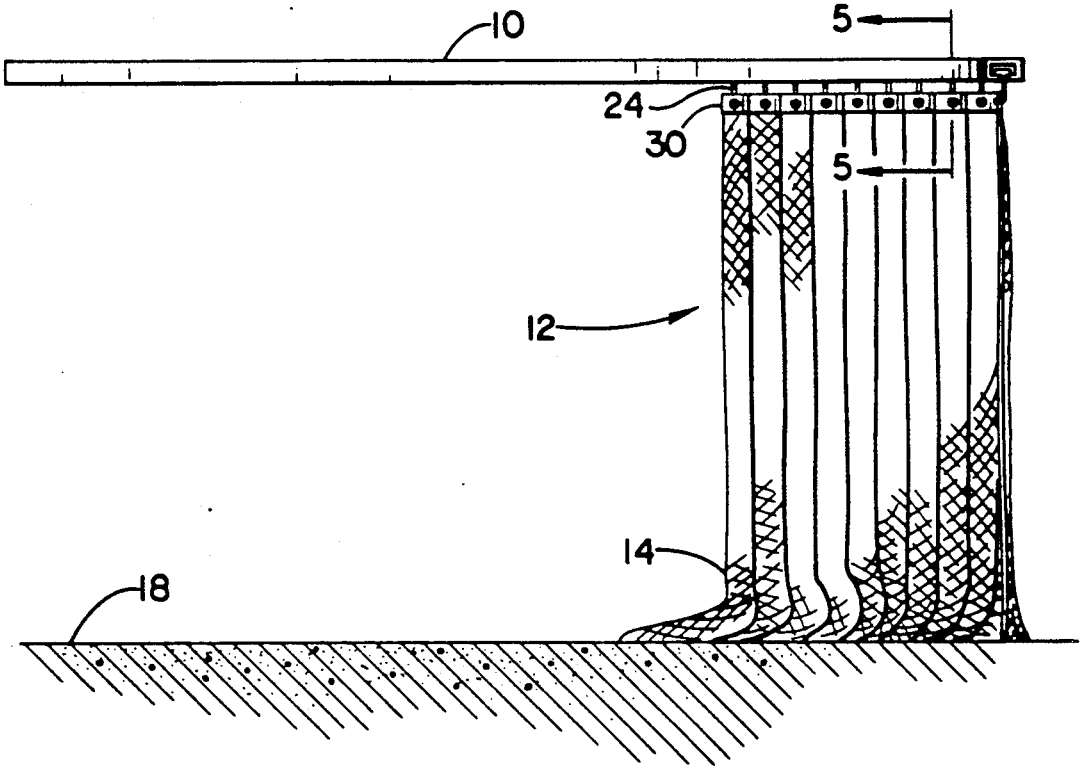
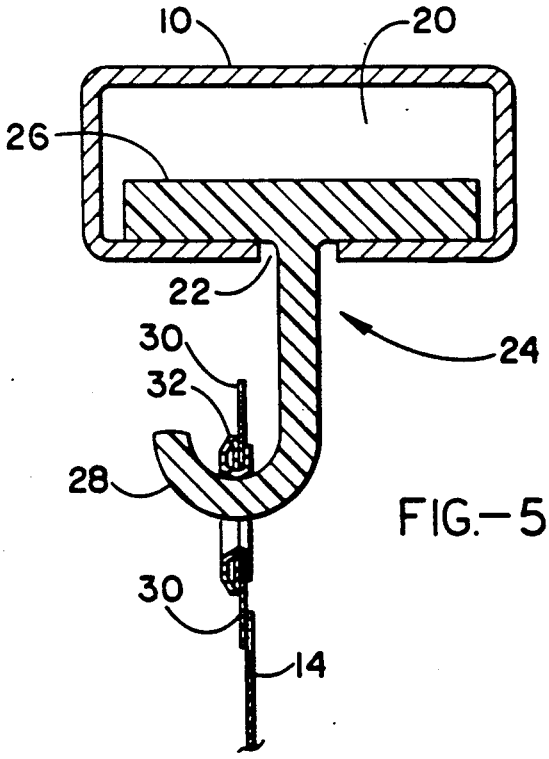
FIG.-5

INDOOR GOLF PRACTICE APPARATUS

BACKGROUND OF THE INVENTION

1. Field of the Invention

This invention pertains to a golf practice apparatus generally and more specifically to an apparatus for practicing golf swings indoors, such as in a building or the garage in a house. The apparatus is suspended from the ceiling and can easily be stored when not in use. Golf balls directed toward the apparatus are restrained from causing damage to walls and other adjacent objects.

In order to practice their golf swings, golfers typically go to a golf course or driving range. Golf courses and driving ranges are often a considerable distance from the golfer's home, and are often inaccessible or impractical to use due to poor weather conditions. The apparatus disclosed herein permits a golfer to practice his or her swings at home or some other indoor location, without concern for weather conditions.

2. Description of the Background Art

Various devices for practicing golf have been developed over the years. However, these devices typically require a sheet of fabric or netting to be supported by a frame, are bulky, and must be disassembled for storage. Furthermore, they do not restrain balls which are hit off of the "toe" of the club as does the invention disclosed herein.

For example, U.S. Pat. No. 3,558,140, issued to Romeo on Jan. 26, 1971, discloses a golf practice apparatus which simulates a putting green. The apparatus comprises a backdrop which depicts a putting green and has slits along the lower and side boundaries of the green so that a golf ball hitting the target area will pass through the slit and drop into a collection trough.

U.S. Pat. No. 4,511,146, issued to Windall on Apr. 16, 1985, discloses a practice golf net which is suspended from a frame and contains a mechanism to signal the impact strength imparted to the ball, the direction the ball takes, and the loft that the ball assumes after being struck.

U.S. Pat. No. 3,784,207, issued to Gentiluomo on Jan. 8, 1974, discloses a golf practice apparatus for improving accuracy. Separate players' lanes are established by the use of netting to prevent balls from cross-firing into adjacent lanes.

Additionally, various means for suspending sheets of fabric and other materials from overhead support structures have been developed.

For example, U.S. Pat. No. 4,793,399 issued to Pryor on Dec. 27, 1988, discloses a hanger assembly for suspending an article or articles such as a curtain or other flexible sheet material below a support rail, said support rail containing a channel such that the material which is supported can be moved to different positions relative to the ends of the support rail.

U.S. Pat. No. 3,392,420, issued to Kless on Jul. 16, 1968, discloses a curtain suspension assembly having a pair of rails and a plurality of curtain carriers supported by and movable along the rails.

U.S. Pat. No. 4,557,311, issued to Reining on Dec. 10, 1985, discloses a shade which can be stretched across a balcony of a building and stored pulled to one side of an overhead suspension assembly when not in use. The upper part of the shade is guided by means of hooks or rollers attached to a drapery rod attached to the wall.

U.S. Pat. No. 4,180,352, issued to Divers on Dec. 25, 1979, discloses a panel and support system for use in mine ventilation shafts. The panel is weighted at the bottom to provide an effective seal and supported overhead by a cantilevered support system.

U.S. Pat. No. 1,818,786, issued to Bond on Aug. 11, 1931, discloses an apparatus for suspending curtains, and more specifically a master carrier for curtain tracks.

U.S. Pat. No. 4,623,013, issued to Gross on Nov. 18, 1986, discloses an adjustable drape and rod assembly.

U.S. Pat. No. 1,206,421, issued to Dickey et al. on Nov. 28, 1916, discloses an eye and loop curtain hanger.

U.S. Pat. No. 3,434,524, issued to Fein on Mar. 25, 1969, discloses a track mounted curtain suspension apparatus which creates a simulated pleated appearance.

Finally, in its catalogs, Manufacturing Specialties Co. advertises various types of curtain track assemblies.

The foregoing patents and publications reflect the state of the art of which the applicant is aware and are tendered with the view toward discharging applicant's acknowledged duty of candor in disclosing information which may be pertinent in the examination of this application. It is respectfully stipulated, however, that none of these patents or publications teach or render obvious, singly or when considered in combination, applicant's claimed invention.

SUMMARY OF THE INVENTION

This invention pertains to an indoor golf practice apparatus which is suspended from the ceiling of a building or other structure.

The apparatus comprises a square or rectangular sheet of fabric or netting which is suspended from an overhead structure along its top edge. The net extends in a downward direction toward the floor or other playing surface. The length of the net is longer than the distance between the support structure and the playing surface so that the bottom of the net can be scrolled to form a seal with the playing surface and to provide a trough for catching balls which drop after being restrained by the net.

The net is suspended from an overhead structure such as the garage rafters or ceiling in a house by an elongated support rail and plurality of hangers. The support rail has a channel which defines a downwardly facing recess along which the hangers are attached. The hangers are attached to the support rail in such a manner that they can slide along the channel from one end of the support rail to the other. The net, which is also fastened to the hangers, can be extended along the length of the support rail or retracted to one side to the other for storage when not in use.

The apparatus also comprises a mat which is placed upon the playing surface. The mat, which is formed from a material such as astroturf, has a flexible golf tee attached upon which a golf ball is placed. The user then swings at the golf ball which is directed toward and restrained by the net. Golf balls which hit the net drop into the scrolled bottom of the net and are thereby prevented from rolling around the playing surface. Low flying golf balls are prevented from rolling under the net by the seal with the playing surface created by the scrolled bottom of the net.

An object of the invention is to provide an apparatus for practicing golf swings indoors.

Another object of the invention is to provide an apparatus which can be easily stored when not in use, without disassembly.

Another object of the invention is to restrain golf balls which are hit indoors.

Another object of the invention is to support a golf net without the need for a frame supporting the edges of the net.

Another object of the invention is to restrain prevent golf balls from rolling around the playing surface after they are restrained by an overhead suspended net.

Another object of the invention is to prevent golf balls which are hit at low angles relative to a overhead suspended net from rolling under the net.

Another object of the invention is to restrain golf ball which are hit off of the "toe" of the club.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 2 is a side elevation of the apparatus depicted in FIG. 1 in a retracted position of non-use or readiness.

FIG. 5 is a cross-sectional view of a support rail of the apparatus depicted in FIG. 1 showing the configuration and attachment of a net hanger.

DETAILED DESCRIPTION OF THE PREFERRED EMBODIMENTS

Figure 1:
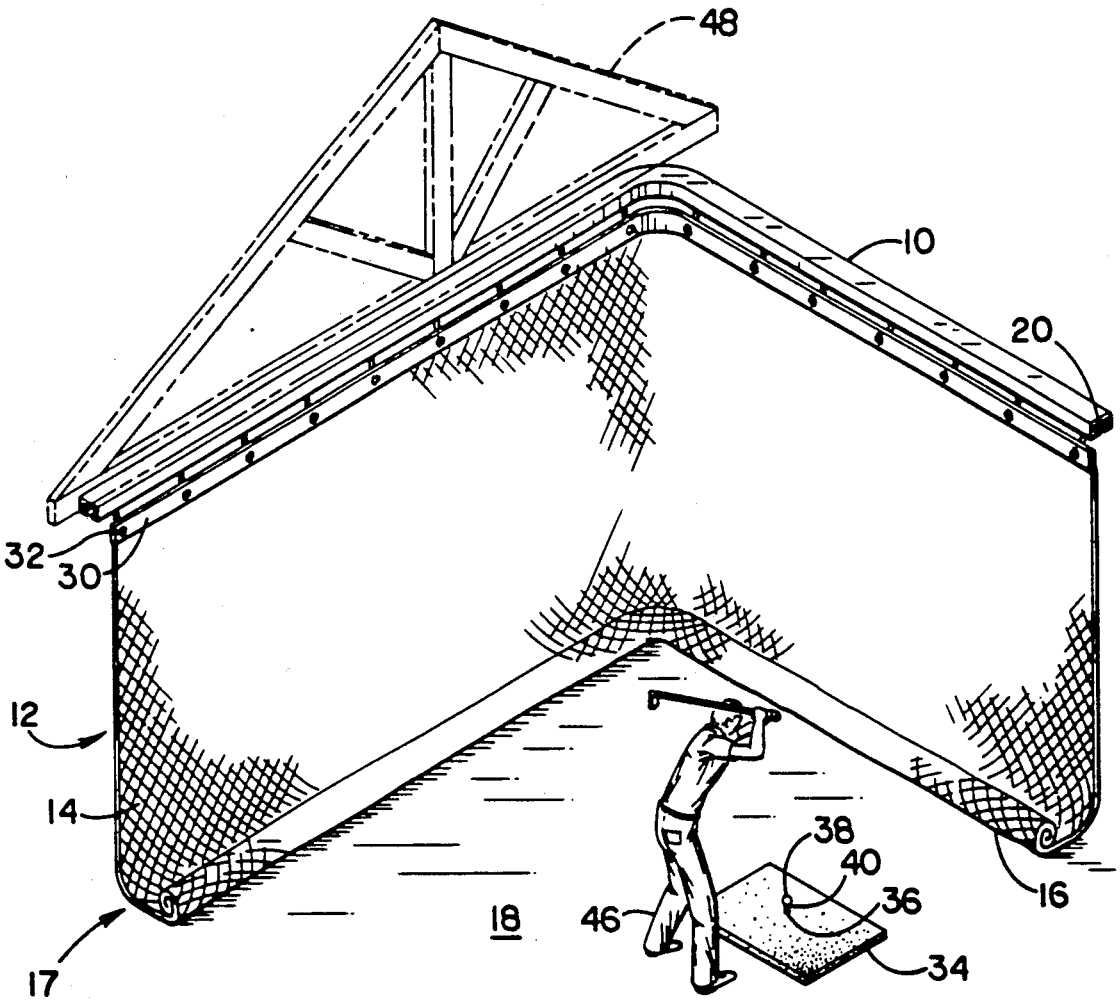
FIG. 1 is a perspective view of a preferred embodiment of the invention.

Referring more specifically to the drawings, for illustrative purposes a preferred embodiment of the present invention is shown in FIG. 1. It will be appreciated that the apparatus may vary as to configuration and as to details of the parts without departing from the basic concepts as disclosed herein.

The apparatus is suspended from an overhead support structure by means of elongated support rail 10. Support rail 10 can be made from aluminum, steel, wood, plastic or other material. Aluminum is preferred due to its light weight and corrosion resistant properties.

Referring to FIG. 1 and FIG. 5, support rail 10 contains a downwardly facing channel 20 having a recessed slot 22 which constitutes a track. Slot 22 accepts a plurality of hangers 24 as shown in detail in FIG. 5.

For ease of construction, support rail 10 can be made from rails used for hanging curtains and draperies.

Referring now to FIG. 5, hanger 24 has a disc 26 and a hook 28. Disc 26 and hook 28 can be joined by any common fastening means, or hanger 24 can be molded as a single integrated piece from plastic or other material which can support the weight of net assembly 12.

Disc 22 is larger than the opening formed by slot 22 so that hanger 24 does not slip through the opening, but is smaller than channel 20 so that hanger 24 can freely slide along support rail 10. The shaft of hook 28 is smaller than the opening formed by slot 22 so that hanger 24 can move freely along support rail 10.

Referring again to FIG. 1, net assembly 12 is suspended from support rail 10 by means of a plurality of hangers 24 as shown and extends downward toward playing surface 18. Net assembly 12 is made from a fabric sheet or net 14. The preferred embodiment uses "golf net" because of its inherent strength and durability. Golf net has an openwork pattern to its weave, the openings in which are sufficiently small to prevent a golf ball from passing through.

The top edge of net 14 which is to be suspended from plurality of hangers 2 is reinforced with binding 30. Binding 30 can be made of canvas or other material to which net 14 can be attached. Spaced along binding 30 and corresponding to points at which net assembly 12 is to be fastened to hangers 24, are eyelets 32 which form reinforced holes in binding 30. Eyelets 32 can be made of brass, aluminum, or other materials. The opening in an eyelet 32 is of sufficient size so as to accept hook 28.

The length of net 14 is greater than the height of support rail 10 above playing surface 18 so that the bottom edge of net 14 can be rolled back onto itself to form scroll 16. Scroll 16 has three significant functions. First, scroll 16 forms a seal between net 14 and playing surface 18. This configuration prevents golf balls which are directed at a low angle toward net 14 from rolling beneath net assembly 12. Second, scrolling the bottom edge of net 14 will also add weight to the bottom of net assembly 12 thereby taking up the slack as desired and giving a stabilizing effect. Third, and most important, scroll 16 forms a trough 17 positioned longitudinally along the bottom of net 14 which catches golf balls restrained by net 14. This prevents golf balls from rolling around playing surface 18 when they fall after being restrained by net 14.

Referring to FIG. 2, the apparatus can easily be stored when not in use by pulling net assembly !2 to one side of support rail 10. This is easily accomplished since hangers 24 freely slide in channel 20 longitudinally along support rail 10. This is an important feature where space is limited.

Figure 3:
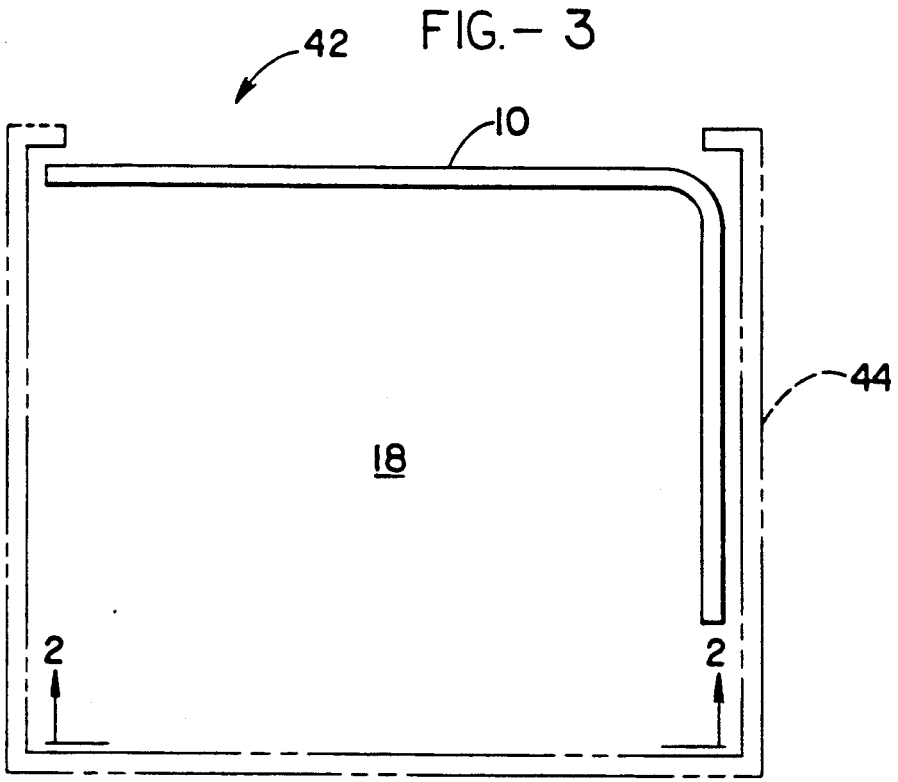
FIG. 3 is a top plan view of the apparatus depicted in FIG. 1 showing a curved support rail positioned above the vehicular door opening and one side wall of a garage.
Figure 4:
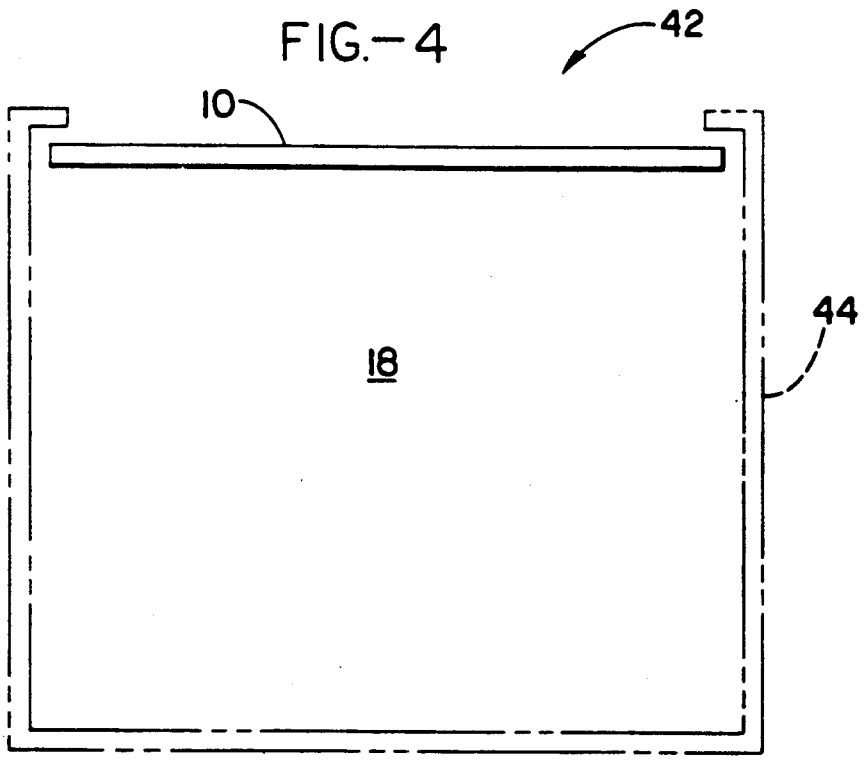
FIG. 4 is a top plan view of an alternative embodiment of the apparatus depicted in FIG. 1 showing a straight support rail positioned above the vehicular door opening of a garage.

FIG. 1, FIG. 3 and FIG. 4 show examples of how the apparatus could be installed in the garage of a house. FIG. 1 shows support rail 10 being attached to an overhead roof support truss 48. FIG. 3 and FIG. 4 show alternative embodiments of the apparatus where support rail 10 is positioned above and longitudinally along vehicular garage door opening 42. When the apparatus is not in use or when normal vehicular access is required, net assembly 12 can be pulled to one side of support rail 10 and stored next to wall 44. These alterative embodiments can be also be used for installing the apparatus in other indoor locations.

Referring to FIG. and FIG. 3, in the preferred embodiment one leg of support rail 10 is positioned longitudinally along garage door opening 42 and a second leg of support rail 10 curves around in a clockwise direction and is positioned longitudinally along wall 44. A sweeping curve is preferred but any radius or angle of curvature would be acceptable, the size and shape of the curve being determined by the position of the walls along which support rail 10 is installed.

This embodiment is distinctly advantageous in that a golf ball which is hit off of the "toe" of the club head (e.g., sliced) is still restrained. In normal play, player 46 directs golf ball 38 toward the portion of net assembly 12 which is positioned along garage door opening 42.

Balls which are "sliced" deviate from their intended course toward wall 44 where they are still restrained by net assembly 12. This embodiment also permits net assembly 12 to be moved completely away from garage door opening 42 and stored along wall 44.

Being evident that the foregoing embodiment assumes a right handed player, for left handed players support rail 10 is positioned such that one leg curves around in a counter-clockwise direction and is positioned longitudinally along the wall directly opposite wall 44.

Referring now to FIG. 4, an alternative embodiment uses a straight support rail 10. Although this embodiment does not restrain balls which are hit off of the toe of the club head, it can be used where installation space is limited.

Referring again to FIG. 1, the apparatus also comprises a playing mat 34 to which golf tee 36 is attached. Playing mat 34 can be made of astroturf, rubber, plastic or other flexible material which simulates a grassy surface. By using a flexible material, playing mat 34 can be rolled up for storage. Golf tee 36 is also made from rubber or other flexible material so that golf tee 36 will deflect when struck and breakage will not occur. Golf tee 36 is vertically oriented with reference to playing mat 24 and contains a receptacle 40 for holding golf ball 38.

To use the apparatus golfer 46 stands in a position adjacent to playing mat 34 and directs golf ball 38 toward net assembly 12. Net assembly 12, and more particularly net 14, restrains golf ball 38 and golf ball 38 drops into trough 17.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An indoor golf ball restraining apparatus, comprising:

(a) a net, said net having a bottom edge and a reinforced top edge, said net having an openwork weave pattern through which a golf ball cannot pass;

(b) an elongated support rail for attachment to an overhead ceiling structure of a building, said support rail having a first end and a second end, said support rail including a track, said support rail having a first member and a second member, said first and second members being joined at one end, said first member positioned approximately perpendicular to said second member;

(c) a plurality of hangers, said hangers being slidably positioned in said track, said hangers being attached to said reinforced top edge of said net, said net extending downward from said support rail toward a playing surface, said net being retractable as said hangers are moved longitudinally along said support rail, said bottom edge of said net adapted to form a seal with said playing surface, said seal preventing a golf ball from passing between said bottom edge of said net and said playing surface;

(d) a flexible mat; and (e) a flexible golf tee, said tee being mounted to said mat in a vertical orientation and having a receptacle into which a golf ball to be directed toward said net can be placed.

2. An indoor golf practice apparatus for suspension from the ceiling of a building structure, comprising:

(a) an elongated support rail for attachment to an overhead ceiling structure of a building, said elongated support rail having a first member and a second member, said first and second members being joined at one end, said first member positioned approximately perpendicular to said second member;

(b) a net, said net having a bottom edge and a reinforced top edge, said net having an openwork pattern through which a golf ball cannot pass, said bottom edge of said net adapted to form a seal with a playing surface, said seal edge of said net and said playing surface, said net being scrolled near said bottom edge, said scroll adapted to form said seal with said playing surface, said scroll forming a trough positioned longitudinally along said playing surface for retention of a golf ball after striking said net; and (c) a plurality of hangers, said hangers being slidably attached to said support rail, said hangers being attached to said reinforced top edge of said net, said net extending downward from said support rail toward said playing surface, said net being retractable as said hangers are moved longitudinally along said support rail, whereby said net can be retracted toward one end of said support rail when not in use.

3. An indoor golf practice apparatus for suspension from the ceiling of a building structure, comprising:

(a) an elongated support rail for attachment to an overhead ceiling structure of a building, said elongated support rail having a first member and a second member, said first and second members being joined at one end, said first member positioned approximately perpendicular to said second member;

(b) a net, said net having a bottom edge and a reinforced top edge, said net having an openwork pattern through which a golf ball cannot pass, said bottom edge of said net adapted to form a seal with said playing surface, said seal preventing a golf ball from passing between said bottom edge of said net and said playing surface, said net being scrolled near said bottom edge, said scroll adapted to form said seal with said playing surface, said scroll forming a trough positioned longitudinally along said playing surface for retention of a golf ball after striking said net;

(c) a plurality of hangers, said hangers being slidably attached to said support rail, said hangers being attached to said reinforced top edge of said net, said net extending downward from said support rail toward said playing surface, said net being retractable as said hangers are moved longitudinally along said support rail, whereby said net can be retracted toward one end of said support rail when not in use;

(d) a flexible mat; and (e) a flexible golf tee, said tee being mounted to said mat in a vertical orientation and having a receptacle into which a golf ball to be directed toward said net can be placed.

* * * * *